United States Patent [19]

Bächtiger

[11] Patent Number: 4,506,615

[45] Date of Patent: Mar. 26, 1985

[54] METHOD FOR ATTACHING READY-MADE PIECES OF MATERIAL TO ANOTHER PIECE OF MATERIAL

[75] Inventor: Hans Bächtiger, Stallikon, Switzerland

[73] Assignee: Gygli Technik AG, Kollermuhle, Switzerland

[21] Appl. No.: 420,245

[22] PCT Filed: Jan. 19, 1982

[86] PCT No.: PCT/CH82/00008

§ 371 Date: Sep. 16, 1982

§ 102(e) Date: Sep. 16, 1982

[87] PCT Pub. No.: WO82/02478

PCT Pub. Date: Aug. 5, 1982

[30] Foreign Application Priority Data

Jan. 22, 1981 [CH] Switzerland ..... 415/81

[51] Int. Cl.[3] ..... D05B 1/00

[52] U.S. Cl. ..... 112/262.1; 2/129; 2/143; 112/147

[58] Field of Search ..... 2/143, 132, 129; 112/141, 142, 147, 121.11, 262.1

[56] References Cited

U.S. PATENT DOCUMENTS 1,928,838 0/1933 Marcus .
2,131,055 0/1938 Ladue .
3,277,853 10/1966 Tucci ..... 112/147
3,333,280 8/1967 Hynek et al. ..... 2/143
3,600,220 8/1971 Marforio ..... 112/141
4,184,439 1/1980 Schulz ..... 112/147
4,271,772 6/1981 Pignatti ..... 112/147

FOREIGN PATENT DOCUMENTS 2353404 5/1975 Fed. Rep. of Germany ..... 112/141

*Primary Examiner*—Ronald Feldbaum

*Attorney, Agent, or Firm*—Roylance, Abrams, Berdo & Goodman

[57] ABSTRACT

For attaching a ready-made piece of material, for avoiding open selvedges on the finished article of clothing, initially an insert (E) is joined to an outer and a lower layer of material (01,02) and presewn by a seam (2). Material (01) is then folded upwards and the other material (02) downwards. Simultaneously, an adhesive thread (A, B) is supplied to each of the folded selvedges (20), the two folds then being fixed by means of pressure and heat. The ready-made piece of material is now turned and stitched by a seam (3). The selvedge of a further piece of material (H) is now inserted between the fixed folds and is fastened by a seam (5). This simplifies and accelerates attachment and in addition sewing cotton is saved. This production procedure can be used in the laundry and clothes production industries.

19 Claims, 19 Drawing Figures

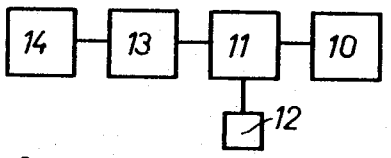
FIG. 3
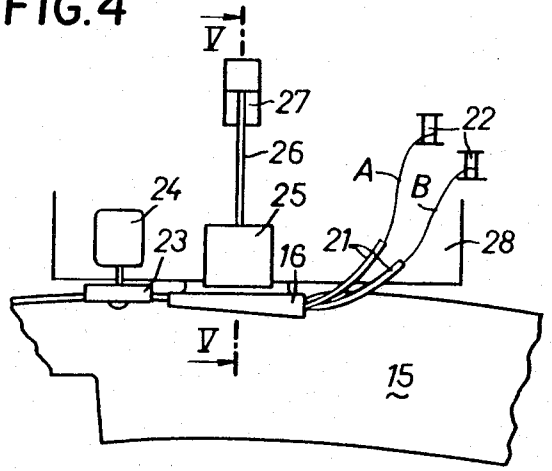
FIG. 4
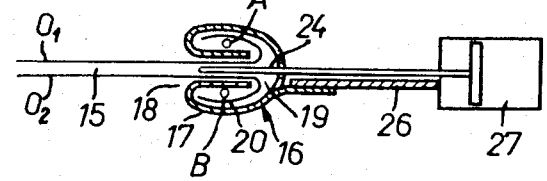
FIG. 5
PRIOR ART
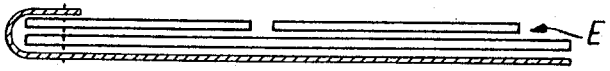
FIG. 1a
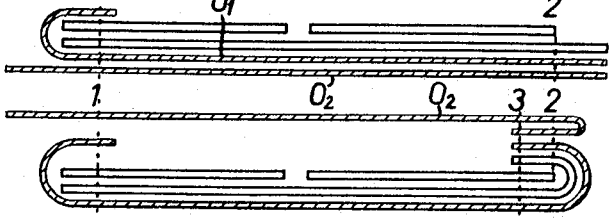
FIG. 1b
FIG. 1c
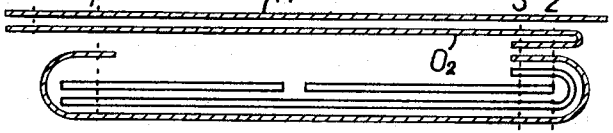
FIG. 1d
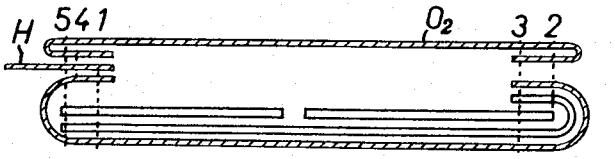
FIG. 1e
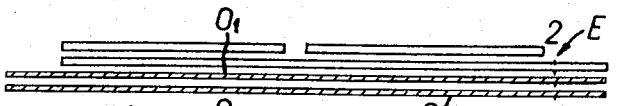
FIG. 2a
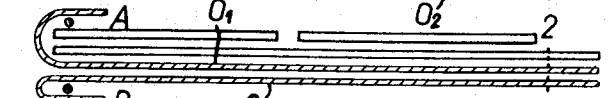
FIG. 2b
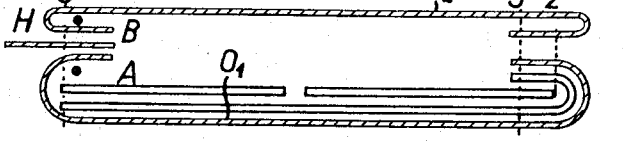
FIG. 2c

METHOD FOR ATTACHING READY-MADE PIECES OF MATERIAL TO ANOTHER PIECE OF MATERIAL

FIELD OF THE INVENTION

The invention relates to a method for attaching ready-made pieces of material, particularly collars, cuffs, button and buttonhole tapes and other trimmings to a further piece of material, the ready-made piece of material being made from at least two material portions and is ready to be attached, a selvedge of the further piece of material then being connected to the ready-made piece of material.

BACKGROUND OF THE INVENTION

In the clothing industry, parts such as shirt, blouse and clothing collars, cuffs, button and buttonhole tapes, etc are made in separate operations and are subsequently attached by means of further operations. A relatively large number of operations cannot be avoided, so that the expenditure is relatively high. It is particularly difficult to sew the open selvedge of the ready-made piece to the selvedge of another piece of material and it must therefore be carefully performed by trained personnel.

SUMMARY OF THE INVENTION

The problem of the invention is to so develop a method of the aforementioned type that the number of sewing processes are reduced and these processes can be performed without careful matching of the parts to be sewn.

According to the invention, this problem is solved in that selvedges of the parts of the ready-made piece of material which are to be sewn together with the further piece of material are bent round in opposite directions, folded and fixed in the folded state.

The invention also covers an apparatus for performing the method according to the invention having guide means for guiding the piece of material, folding means for folding the selvedges of the parts of the ready-made piece of material, supply means for supplying an adhesive to the vicinity of the folding means and fixing means for fixing the folded selvedges.

Other objects, advantages and salient features of the present invention will become apparent from the following detailed description, which, taken in conjunction with the annexed drawings, discloses preferred embodiments of the present invention.

The invention is described in greater detail hereinafter relative to two embodiments shown in the drawings, wherein represent:

FIGS. 1*a–e* the attaching of a shirt collar in diagrammatically represented cross-sections of FIGS. 1*a–d* and its sewing to the shirting in a diagrammatically represented cross-section of FIG. 1*e* according to the prior art.

FIGS. 2*a–c* the attaching of a shirt collar and its sewing to the shirting in diagrammatically represented cross-sections.

FIG. 3 a block diagram of an apparatus for preparing a ready-made piece of material for attachment to a further piece of material.

FIG. 4 a diagrammatic view of the apparatus of FIG. 3.

FIG. 5 a section along line V—V of FIG. 4.

FIGS. 6*a–g* the attaching of a further, partly shown shirt collar up to the fixing of the selvedges provided for sewing to the shirting in diagrammatically represented cross-sections.

FIG. 7 a diagrammatic view of a further apparatus for preparing a ready-made piece of material for attachment to a further piece of material.

DETAILED DESCRIPTION OF PREFERRED EMBODIMENTS

Figure 6A:
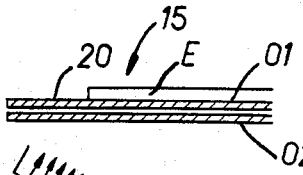

According to the prior art shown in FIGS. 1*a–e,* for attaching a shirt collar, initially an insert E of random design is joined to an outer layer of material 01. According to FIGS. 1*a–e,* insert E can be formed from insert parts. However, it is also possible to stiffen to a varying degree by means of a stiffener at different points the said insert E. However, the design of insert E is unimportant. After joining insert E and the outer layer of material 01, the material which projects downwards by about 6 to 12 mm is wrapped around the lower edge of the insert and sewn by a seam 1 (cf FIG. 1*a*).

According to (b) a lower layer of material 02 is placed on the outer layer 01 and the collar is presewn with a seam 2. According to FIG. 1*c,* the presewn collar is then turned and after turning is stitched by a seam 3. According to FIG. 1*d,* the open selvedge S of material 02 of the underside of the collar is sewn by a seam 4 to shirting H. The final sewing process involves bending round and closing the collar, i.e. by means of a seam 5 it is completely sewn to the intermediate edge of shirting H.

This involves five sewing processes and seam 4 must be very carefully sewn by trained personnel, because even minor movements during the sewing of material 02 of the underside of the collar to shirting H leads to an unsatisfactory fit of the shirt.

FIGS. 2*a–c* shows the attachment of a shirt collar in accordance with the method of the invention. According to FIG. 2*a,* after then joining the outer layer of material 01 connected to the insert (E), e.g. by adhesion and the lower layer of material 02, the collar is sewn together by seam 2. Thus, seam 1 required when attaching the collar according to FIG. 2 is unnecessary.

According to FIG. 2*b,* this is then followed by the bending round of the free selvedges, in that the lower edge of material 01 of the outside of the collar is folded upwards along the lower edge of insert E, whilst the lower edge of material 02 of the underside of the collar is folded downwards at the same point. Simultaneously, with the folding of the selvedges, a monofilament thread A,B of a hot-setting adhesive, e.g. polyamide is inserted in the fold. The hot-setting adhesive A, B is bonded by means of a heat supply immediately after insertion. The hot-setting adhesive need not be in the form of a thread and it can also be introduced into the folded selvedges in powder form. As can be gathered from FIG. 2*b,* the bending round, folding and fixing of materials 01, 02 take place prior to turning. After turning, the collar is stitched by seam 3, of FIG. 2*c.* The upper edge of shirting H is then introduced into the collar and they are fastened together by a seam 5.

Comparison of the method of FIGS. 2*a–c* with that of FIGS. 1*a–c* shows that there is no need for seams 1 and 4 or the associated sewing cotton. The folding and fixing processes can be performed mechanically, so that trained personnel is not required. As the costs of the hot-setting adhesive, no matter whether it is used in the form of a filament or a powder, are much lower than the costs of the sewing cotton saved, the method of FIGS. 2*a–e* offers considerable advantages compared with the prior art method of FIGS. 1*a–e*.

FIGS. 3 to 5 show the apparatus for performing the method of FIGS. 2*a–c*. FIG. 3 shows the individual means required in block diagram form. The collars prepared according to FIG. 2*a* are introduced into a guide 10, which then passes into a folding means 11, in which the free selvedges of the materials are bent. The hot-setting adhesive is simultaneously fed in by feed means 12. The thus prepared selvedges pass into a bonding means 13 immediately adjacent to the folding means 11, in which the free selvedges are bonded. The collar passes from the bonding means 13 into a sewing means 14, where the upper edge of the shirting is inserted and fastened by stitching.

FIG. 4 shows means 11, 12 and 13 of FIG. 3 in greater detail. Collar 15 is introduced into the guides of an apparatus 16 in which the free selvedges are automatically folded. As can be gathered from FIG. 4, apparatus 16 has two superimposed, funnel-shaped hollow bodies 17 between which there is a gap 18, through which can be introduced collar 15 or the free selvedges 20. Hollow bodies 17 are not completely closed and instead have an elongated slot 19 through which extend the selvedges and are bent round. On the inlet side of apparatus 16 there are two tubes 21, through which the two adhesive threads A, B unwound from spools 22 are introduced into the folds formed by apparatus 16. The insertion can take place by means of a compressed air flow which, in not shown manner, is introduced into tubes 21. At the outlet side of apparatus 16, the selvedges are folded and pass between two rotating and heated bonding rollers 23, which are driven by a drive unit 24, e.g. an electric motor. Bonding rollers 23 simultaneously take over the advance of collar 15.

FIGS. 4 and 5 show that for the bending and folding process, a tongue 25 is introduced into the gap 18 between the two materials 01, 02 of collar 15. Tongue 25 is connected to the piston rod of a thrust piston drive 27 which, in not shown manner, is subject to the action of a pressure medium. At the start of fold formation, tongue 25 is drawn back to a collar 15 and after threading the latter into gap 18 is advanced for separating selvedges 20.

Apparatus 16, tubes 21 and drive unit 24 are mounted on a fixed base 28. Base 28 can carry further, not shown means, which ensure a reliable guidance of collar 15.

FIGS. 6*a–g* shows the fixing of selvedges 20 of a piece of material 15, means different from those shown in FIGS. 4 and 5 being used for bending round purposes.

The piece of material 15, e.g. a collar in the initial position according to FIG. 6*a*, is formed from a material 01 (outside of the collar) bonded to an insert E and an underlying material 02 (underside of the collar). The collar is presewn, but not turned.

Figure 6B:
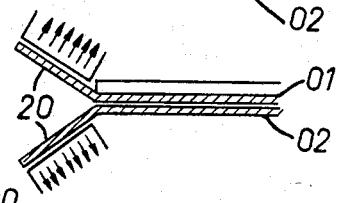
Figure 6C:
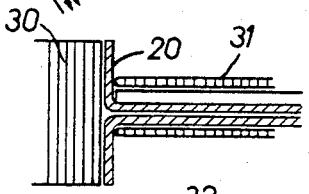
Figure 6D:
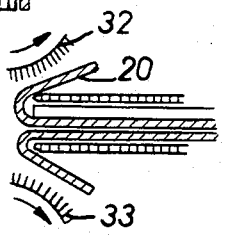
Figure 6E:
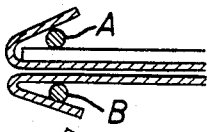
Figure 6F:
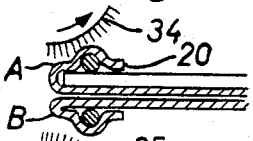
Figure 6G:
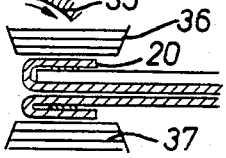

According to FIG. 6*b*, the selvedges 20 are subject to suction action by means of air, e.g. by producing a vacuum, so that on engaging with a stop 30, cf FIG. 6*c*, the selvedges 20 engage therewith in a parallel and aligned apart manner. Simultaneously, collar 15 passes into the vicinity of two holding devices 31 and by a spreading movement, cf FIG. 6*d*, the selvedges 20 are wrapped round, e.g. by a pair of rotary brushes 32, 33. In this position of selvedges 20, the monofilament adhesive A, B is introduced, cf FIG. 6*e*. By means of a further spreading movement, e.g. by a further pair of rotating brushes 34, 35, selvedges 20 are now tautly spread or brushed over the monofilament adhesives A, B, cf FIG. 6*f*. Selvedges 20 are now bonded by a heat supply, e.g. by vibrating heating elements 36, 37, cf FIG. 6*g*.

The attachment of the piece of material or collar 15 made in this way to the shirting takes place in the manner described in FIG. 2*c*.

Figure 7:
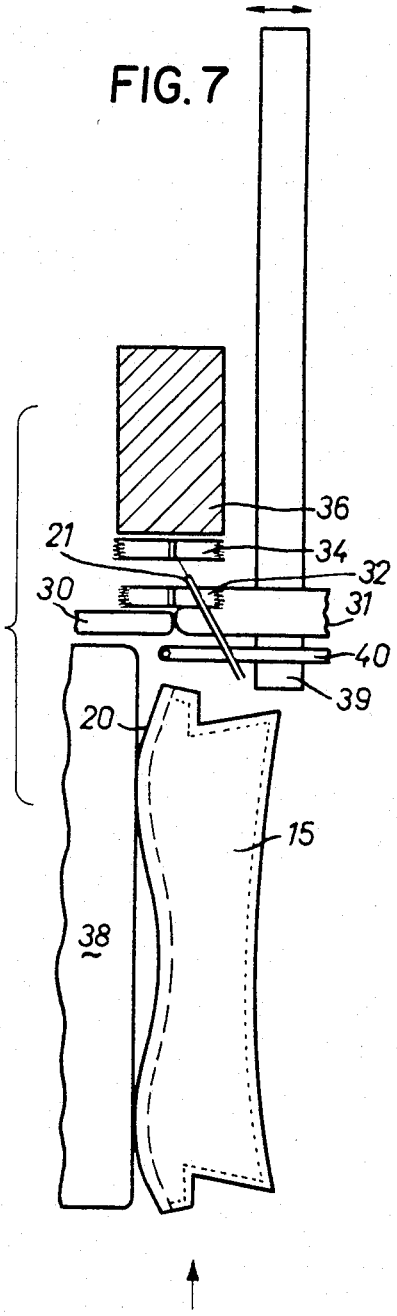

An apparatus according to FIG. 7 can be used for fixing the selvedges 20 according to FIGS. 6*a–g*. Collar 15 with selvedges 20 engages with a stop 38, by which collar 15 is brought into the correct position with respect to the apparatus. A conveyor belt 39 now takes up collar 15 and guides it through the apparatus. The selvedges 20 pass into the vicinity of two air nozzles 40, which separate the selvedges 20 according to in FIG. 6*b*. Conveyor belt 39 performs a controlled reciprocating movement, so that the selvedges 20 are always in the correct position with respect to parts of the apparatus. This is followed by the moving up to the stop 30 and holding devices according to in FIG. 6*c*. This is followed by the bending round of selvedges 20 according to 6*d* in FIG. 6 by a first pair of brushes 32, 33, whereof only brush 32 can be seen in FIG. 7. This is followed by the insertion of the two monofilament adhesives A, B, cf 6*e* in FIG. 6, by means of two tubes 21, whereof only one is shown in FIG. 7. After introducing the monofilament adhesive, the spreading operation according to 6*f* of FIG. 6 is performed by a second pair of brushes 34, 35, whereof only brush 4 is visible in FIG. 7. This is followed by the bonding operation according to 6*g* in FIG. 6 by the vibrating heating elements 36, 37, whereof only element 36 is visible in FIG. 7. Finally, the collar is turned and the shirting attached according to in FIG. 2*c*.

In FIG. 7, the individual parts of the apparatus are drawn apart to the extent that they can be readily recognised. However, in reality, they are moved much closer together, so that the individual operations according to FIGS. 6*b–g* directly follow one another. Finally, conveyor belt 39 can be arranged in such a way that it is not laterally displaceable whilst to ensure adherence to the correct position, the apparatus performs controlled lateral movements along the contour of collar 15.

The method of the invention leads to considerable time savings, e.g. in the production of mens shirts. In connection with the production of the collar, time savings of approximately 30% and more are obtained compared with the time required hitherto. In connection with the total work time required in making such a shirt, this represents a saving of between 5 and 7%. These advantages can be obtained both with the apparatus of FIGS. 5 and 6*a–g* and with that of FIG. 7.

The monofilament adhesive threads and powders can be replaced by other adhesives in liquid or solid form.

In addition, other fields of use are conceivable, for example in the manufacture of curtains.

While various embodiments have been chosen to illustrate the invention, it will be understood by those skilled in the art that various changes and modifications can be made therein without departing from the scope of the invention as defined in the appended claims.

I claim:

1. An apparatus for attaching ready-made pieces of material, particularly collars, cuffs, button and buttonhole tapes and other trimmings to a further piece of material, wherein the ready-made piece of material is made from at least two material portions and is ready to be attached, a selvedge of the further piece of material is then connected to the ready-made piece of material, selvedges of the portions of the ready-made piece of material which are to be sewn together with the further piece of material being bent in opposite directions, folded and fixed in a folded state, the apparatus comprising:

guide means for guiding the piece of the material, folding means for folding the selvedges of the portions of the ready-made piece of material, supply means for supplying an adhesive to the vicinity of the folding means, and fixing means for fixing the folded selvedges.

2. An apparatus according to claim 1 wherein the folding means are superimposed, funnel-shaped hollow bodies provided with an elongated slot.

3. An apparatus according to claim 1 wherein the folding means comprises a stop for engaging the selvedges of the portions of the ready-made piece and holding devices guiding the piece of material on either side and facing said stop.

4. An apparatus according to claim 3 wherein at least one pair of brushes for spreading the selvedges of the piece of material is associated with said stop and said holding devices.

5. An apparatus according to claim 1 wherein the feed means comprise tubes subjected to the action of compressed air and in which monofilament adhesive thread is guided.

6. An apparatus according to claim 1 wherein the fixing means comprise moving heating elements.

7. An apparatus according to claim 2 wherein a reciprocating tongue is arranged between the funnel-shaped hollow bodies.

8. A method of attaching ready-made pieces of material, particularly collars, cuffs, button and buttonhole tapes and other trimmings to a further piece of material, comprising the steps of:

forming a ready-made piece of material from at least two material portions;

bending selvedges of the two material portions of the ready-made piece in opposite directions, folding the selvedges and then fixing the selvedges in folded positions;

turning the ready-made piece after the selvedges of the two material portions have been bent, folded and fixed in the folded positions;

locating a selvedge of a further piece of material between the folded and fixed selvedges of the two material portions; and fastening the selvedges by stitching.

9. A method according to claim 8 wherein the selvedges of the two material portions are fixed by applying a hot-setting adhesive as such selvedges are folded.

10. A method according to claim 9 wherein polyamide adhesive is applied.

11. A method according to claim 9 wherein the adhesive is applied as a thread.

12. A method according to claim 9 wherein the adhesive is applied as a monofilament thread.

13. A method according to claim 8 wherein the selvedges of the two material portions are separated by a fluid.

14. A method according to claim 8 wheren the selvedges of the two material portions are separated by subjecting such selvedges to a partial vacuum.

15. A method according to claim 8 wherein the selvedges of the two material portions are bent and folded by a spreading movement.

16. A method according to claim 15 wherein the selvedges of the two material portions are bent and folded by engaging such selvedges with rotating brushes.

17. A method according to claim 8 wherein the selvedges of the two material portions are bent about holding devices.

18. An apparatus according to claim 6 wherein said heating elements comprise motor-driven, heated bonding rollers.

19. An apparatus according to claim 6 wherein said heating elements comprise vibrating heating elements.

* * * * *